US010227950B1

(12) United States Patent
Dyson, Jr.

(10) Patent No.: US 10,227,950 B1
(45) Date of Patent: Mar. 12, 2019

(54) THERMOACOUSTIC CONVERTOR

(71) Applicant: The United States of America, as represented by the Administrator of the National Aeronautics and Space Administration, Washington, DC (US)

(72) Inventor: Rodger W. Dyson, Jr., Elyria, OH (US)

(73) Assignee: The United States of America as Represented by the Administrator of National Aeronautics and Space Administration, Washington, DC (US)

( * ) Notice: Subject to any disclaimer, the term of this patent is extended or adjusted under 35 U.S.C. 154(b) by 45 days.

(21) Appl. No.: 15/419,571

(22) Filed: Jan. 30, 2017

Related U.S. Application Data

(60) Provisional application No. 62/291,738, filed on Feb. 5, 2016.

(51) Int. Cl.
*F02G 1/044* (2006.01)
*F02G 1/057* (2006.01)
*F02G 1/055* (2006.01)

(52) U.S. Cl.
CPC ..... *F02G 1/044* (2013.01); *F02G 1/055* (2013.01); *F02G 1/057* (2013.01)

(58) Field of Classification Search
CPC ..... F25B 2309/14–2309/1428; F25B 9/145; F02G 2243/00; F02G 2243/50; F02G 2243/52; F02G 2243/54
USPC ..... 60/516, 524, 525, 526, 532; 62/4, 467
See application file for complete search history.

(56) References Cited

U.S. PATENT DOCUMENTS

2003/0192324 A1* 10/2003 Smith ..... F02G 1/0435 62/6
2010/0320949 A1* 12/2010 Fotherby ..... H02M 7/48 318/400.26
2011/0265493 A1* 11/2011 Schwartz ..... F25B 9/145 62/6
2011/0265505 A1* 11/2011 Schwartz ..... F25B 9/145 62/215
2015/0247491 A1* 9/2015 Steiner ..... F03G 7/002 60/518

OTHER PUBLICATIONS

Screen captures from YouTube video clip entitled "Thermo Acoustic Engine," 6 pages, uploaded on Jan. 14, 2013 by user "Grand Illusions". Retrieved from Internet: <https://www.youtube.com/watch?v=wg96IDw7sNw>.*

* cited by examiner

*Primary Examiner* — Mark Laurenzi
*Assistant Examiner* — Mickey France
(74) *Attorney, Agent, or Firm* — Robert H. Earp, III; William M. Johnson

(57) ABSTRACT

A thermoacoustic engine is provided that uses acoustic energy to operate a piston in a double-acting action. The acoustic energy is amplified as a sound wave travels through the thermoacoustic engine. The amplified acoustic energy is extracted and converted into usable electrical energy.

19 Claims, 3 Drawing Sheets

THERMOACOUSTIC CONVERTOR

CROSS-REFERENCE TO RELATED APPLICATIONS

This application claims the benefit of U.S. Provisional Patent Application Ser. No. 62/291,738 entitled "Delta Convertor: Double-Acting Extremely Light Thermo-Acoustic Convertor with No Hot Moving Parts, Maintenance, Lubrication, or Electric Feedback Required" filed on Feb. 5, 2016. The entirety of the above-noted application is incorporated by reference herein.

ORIGIN

The invention described herein was made by employees of the United States Government and may be manufactured and used by or for the Government for Government purposes without the payment of any royalties thereon or therefor.

BACKGROUND

Currently, power generation from an external or internal heat source using thermal energy conversion technologies such as solid-state thermionics and thermoelectrics or dynamic conversion with Otto, Stirling, Brayton, or Rankine technologies are fundamentally limited in their maximum specific power due to either their low efficiency and/or operating frequency. The solid-state technologies are low voltage and hence produce a high DC current which restricts their minimum geometry to approximately 4 $A/mm^2$ to avoid over-heating. Hence, high power implementations of this technology class are inefficient, large, and heavy.

In addition, the dynamic technologies are limited to approximately 400 Hz because of two different reasons. First, the oscillating piston engines such as Stirling and Otto technologies require a force on the piston that grows exponentially with frequency, which is difficult to achieve above 400 Hz with reactive springs or rods. Second, the rotating machines such as Brayton are also limited in frequency of operation because above 24,000 RPM (400 Hz) the rotor tip speed either becomes supersonic or places too much stress on the rotor due to centrifugal forces. Hence, today's space, terrestrial, and proposed aircraft power systems are unnecessarily large and heavy for the power level they provide.

SUMMARY

The following presents a simplified summary of the innovation in order to provide a basic understanding of some aspects of the innovation. This summary is not an extensive overview of the innovation. It is not intended to identify key/critical elements of the innovation or to delineate the scope of the innovation. Its sole purpose is to present some concepts of the innovation in a simplified form as a prelude to the more detailed description that is presented later.

In one aspect, the innovation disclosed herein comprises a thermoacoustic convertor that includes an enclosed tubular structure having a continuous closed loop path defined in an interior thereof, a plurality of thermoacoustic stages disposed in series in the interior of the tubular structure, and a piston disposed in the tubular structure in series with plurality of thermoacoustic stages, wherein initial movement of the piston in a first direction creates a sound wave in the continuous closed loop path in the first direction on a first side of the piston, and wherein as the sound wave passes through each of the plurality of thermoacoustic stages, the sound wave is amplified based on an amplification factor thereby creating an amplified sound wave.

In another aspect of the innovation, an engine that includes an enclosed tubular structure having a continuous closed loop path defined in an interior thereof, at least one cold heat exchanger disposed in the tubular structure, at least one hot heat exchanger disposed in the tubular structure, at least one regenerator disposed between the at least one cold heat exchanger and the at least one hot heat exchanger, a piston disposed in the tubular structure in series with the at least one cold heat exchanger, the at least one hot heat exchanger, and the at least one regenerator, wherein initial movement of the piston in a first direction creates a sound wave in the continuous closed loop path in the first direction, and wherein as the sound wave passes through the at least one regenerator, the sound wave is amplified based on an amplification factor thereby creating an amplified sound wave.

In still another aspect of the innovation, a method of operating a thermoacoustic engine is disclosed that includes providing cold heat exchangers, hot heat exchangers, regenerators disposed between the cold heat exchangers and the hot heat exchangers, and a piston all of which are disposed inside hollow interconnecting tubes, providing a power to the piston, moving the piston in a first direction, creating a sound wave in the hollow interconnecting tubes on a first side of the piston in the first direction, shifting a phase of wave components of the sound wave to align the phases of the wave components as the sound wave travels through the cold heat exchangers, amplifying the sound wave as the sound wave travels through the regenerator thereby creating an amplified sound wave, creating a subsequent sound wave on the first side of the piston in the first direction, and extracting another portion of the power from the sound wave via a transducer.

To the accomplishment of the foregoing and related ends, certain illustrative aspects of the innovation are described herein in connection with the following description and the annexed drawings. These aspects are indicative, however, of but a few of the various ways in which the principles of the innovation can be employed and the subject innovation is intended to include all such aspects and their equivalents. Other advantages and novel features of the innovation will become apparent from the following detailed description of the innovation when considered in conjunction with the drawings.

DETAILED DESCRIPTION

Figure 1:
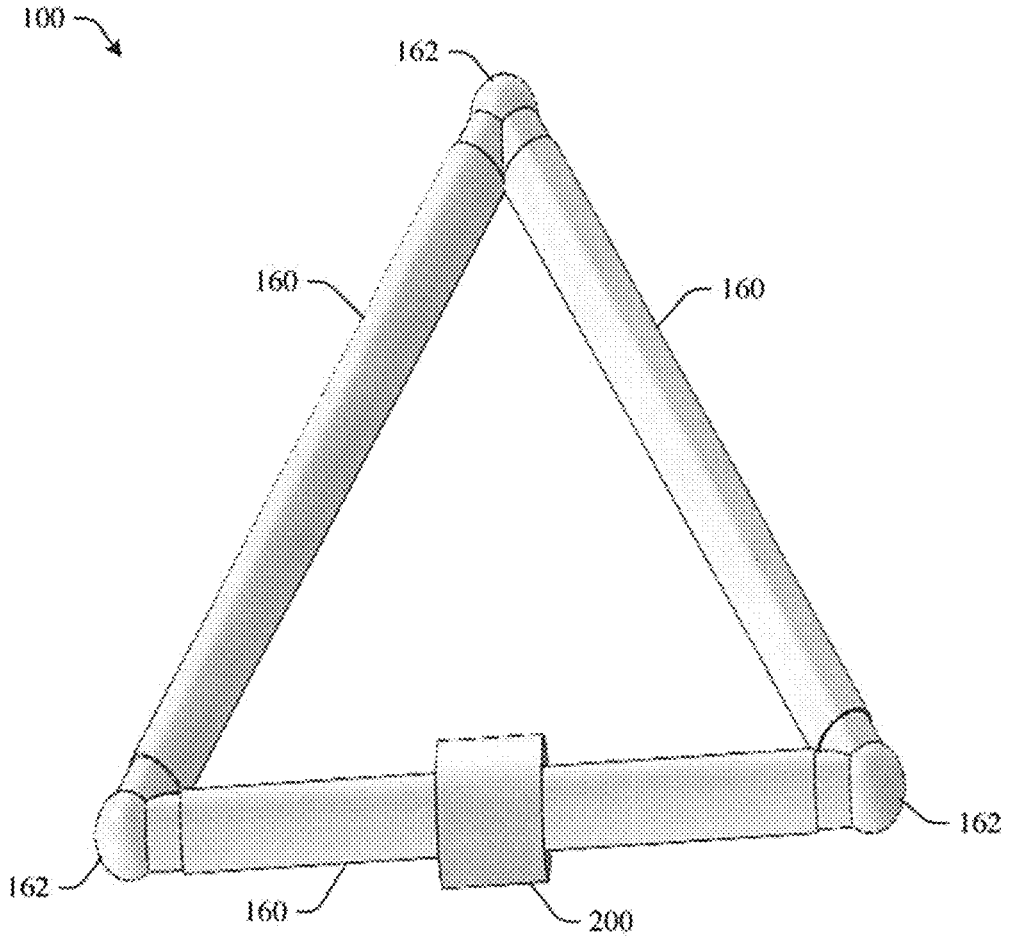
FIG. 1 is a perspective view of an innovative thermoacoustic convertor in accordance with an aspect of the innovation.

The innovation is now described with reference to the drawings, wherein like reference numerals are used to refer to like elements throughout. In the following description, for purposes of explanation, numerous specific details are set forth in order to provide a thorough understanding of the subject innovation. It may be evident, however, that the innovation can be practiced without these specific details.

While specific characteristics are described herein (e.g., thickness, orientation, configuration, etc.), it is to be understood that the features, functions and benefits of the innovation can employ characteristics that vary from those described herein. These alternatives are to be included within the scope of the innovation and claims appended hereto.

While, for purposes of simplicity of explanation, the one or more methodologies shown herein, e.g., in the form of a flow chart, are shown and described as a series of acts, it is to be understood and appreciated that the subject innovation is not limited by the order of acts, as some acts may, in accordance with the innovation, occur in a different order and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the innovation.

As mentioned above, many power systems grow substantially in size and weight as their power level increases due to limitations in their achievable current flow, required reactive force, or excessive centrifugal force. For example, solid-state energy conversion systems tend to be low voltage/high current devices and require many pairs in series for higher power. And while turbines and motors scale up to very high power, they are limited in their specific power by the high centrifugal forces as their rotational speed increases. In addition, oscillating piston engines require exponentially growing reactive piston forces as the frequency increases hence, their power density is limited as well.

In order to overcome these and the aforementioned disadvantages, a new thermoacoustic engine technology is disclosed herein that overcomes these limitations by operating at a much higher frequency than is conventionally achievable. The innovative thermoacoustic engine is based on a double-acting push/pull piston engine in which an acoustic wave pushes both sides of a single piston. This configuration eliminates the need for large springs while requiring only a single piston and engine to operate. In addition, the innovative configuration enables an order of magnitude improvement in specific power compared to conventional engines.

Figure 2:
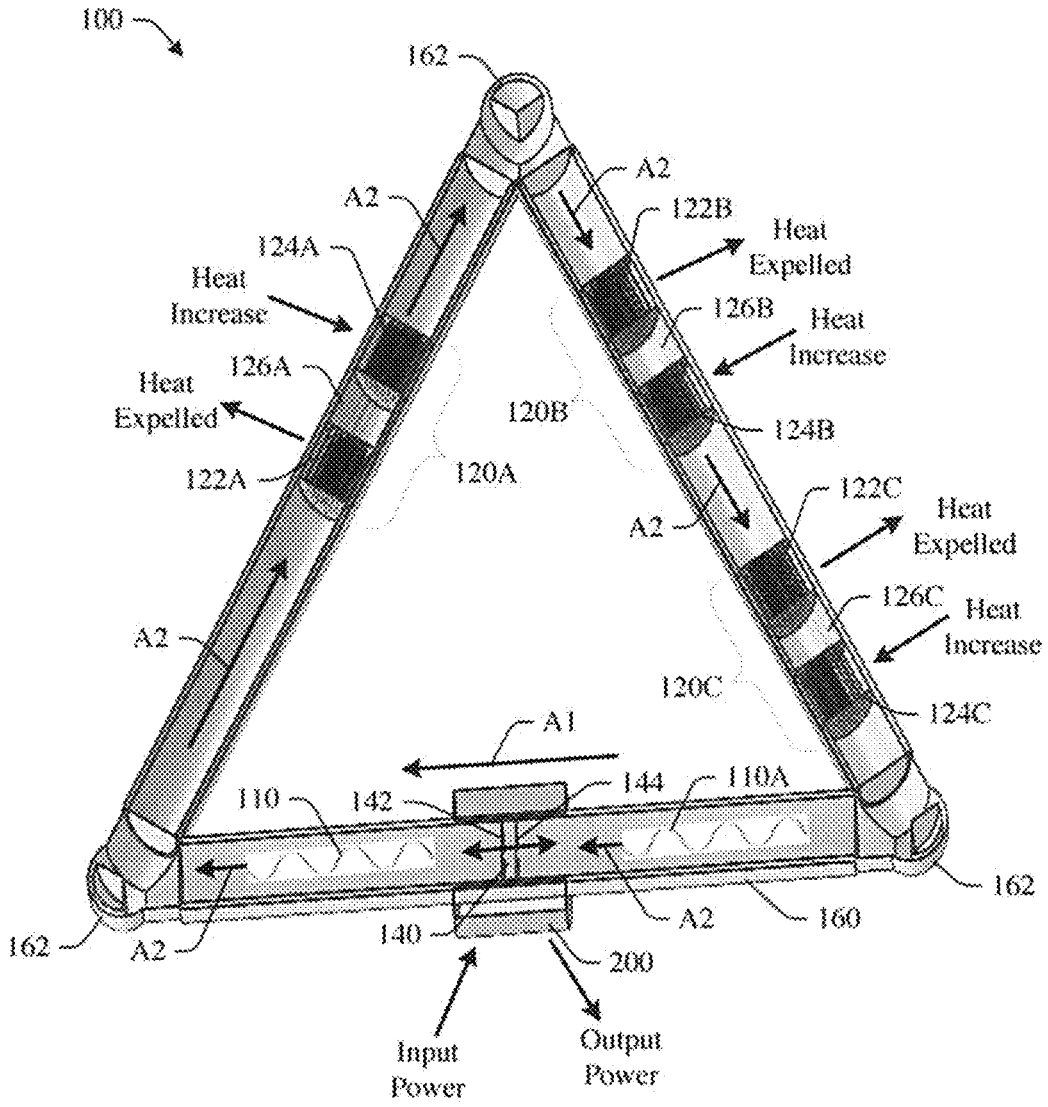
FIG. 2 is a cross-section, perspective view of the innovative thermoacoustic convertor in accordance with aspects of the innovation.

Referring now to the drawings, FIG. 1 is a perspective view and FIG. 2 is a cross-section view of a thermoacoustic convertor (engine) 100 in accordance with an aspect of the innovation. The thermoacoustic convertor 100 creates a sound (acoustic) wave 110 that has an initial input mechanical power and amplifies (increases) the input mechanical power of the sound wave 110 to generate a mechanical output power, which is then converted to usable electrical power. A linear alternator or other type of transducer 200 is connected to the thermoacoustic convertor 100 and is used to provide the initial input power and to convert the amplified output power to usable electrical energy. The thermoacoustic convertor 100 has a simple tubular geometry and construction, is extremely light in weight, and is a double-acting convertor that can achieve higher than 400 Hz operation. At that frequency the thermoacoustic convertor 100 can produce approximately four times more power than conventional engines operating at 100 Hz.

It is to be understood, that the thermoacoustic convertor 100 can be any polygonal or non-polygonal geometric shape based on the application, such as but not limited to a triangle, square, trapezoid, toroid, oval, coaxial, an irregular shape, etc. For sake of illustration, the example embodiment described herein and illustrated in the figures has a triangle shape and is referred to as a Delta thermoacoustic convertor. Thus, the example thermoacoustic convertor 100 described herein and illustrated in the figures is for illustrative purposes only and is not intended to limit the scope of the innovation.

The thermoacoustic convertor 100 is comprised of multiple thermoacoustic (heat exchanger) stages, a first stage 120A, a second stage 120B, and a third stage 120C (collectively 120A-C), and a piston 140 arranged in a series configuration. The stages 120A-C and piston 140 are housed in an enclosed tubular structure comprised of hollow, interconnecting tubes 160 that are connected at junctions 162. The interconnecting tubes 160 are connected to each other such that they form a closed loop and are made from metal, such as but not limited to steel, stainless steel, copper, etc. Thus, a continuous, closed loop path is defined in an interior of the thermoacoustic convertor 100. The closed loop path and hence, the thermoacoustic convertor 100 is filled with gas, such as but not limited to hydrogen, helium, etc. It is to be understood that the number of thermoacoustic stages can vary based on the application of the thermoacoustic convertor. Thus, as mentioned above, the example thermoacoustic convertor 100 described herein and illustrated in the figures is for illustrative purposes only and is not intended to limit the scope of the innovation.

The first thermoacoustic stage 120A includes a first (cold) heat exchanger 122A, a second (hot) heat exchanger 124A, and a first regenerator 126A that are all made from metal, such as but not limited to steel, stainless steel, copper, etc. The second thermoacoustic stage 120A includes a third (cold) heat exchanger 122B, a fourth (hot) heat exchanger 124B, and a second regenerator 126B. The third thermoacoustic stage 120C includes a fifth (cold) heat exchanger 122C, a sixth (hot) heat exchanger 124C, and a third regenerator 126C.

The piston 140 oscillates in a back and forth motion as indicated by the double arrow A in FIG. 2. In order to achieve the push-pull action on the piston 140, the piston 140 is located at the beginning of one thermoacoustic stage and at the end of another thermoacoustic stage. In the example embodiment disclosed herein, the piston 140 is located at a beginning of the first thermoacoustic stage 120A and at the end of the third thermoacoustic stage 120C. Thus, since the interior of the thermoacoustic convertor 100 is a continuous loop, the forces generated by the thermoacoustic stages 120A, 120B, 120C create a push-pull action on the piston 140 thereby creating a single double-acting piston 140. In other words, the thermoacoustic stages 120A-C are designed such that when the piston 140 moves it simultaneously creates an acoustic wave on one side while receiving acoustic power on an opposite side. The pressure forces from the thermoacoustic stages 120A-C push and pull on both sides of the piston 140, which enables much higher forces on the piston 140 than is possible if the typically one-sided power pistons are used with only a bounce space on the opposite side.

The cold heat exchangers 122A, 122B, 122C are configured to remove heat from the gas inside the thermoacoustic convertor 100 and expel it into the environment via convection. The hot heat exchangers 124A, 124B, 124C are configured to increase the temperature of the gas. Thus, a temperature gradient is formed from the cold heat exchanger (first) side of each regenerator 126A, 126B, 126C to the hot heat exchanger (second) side of each regenerator 126A, 126B, 126C. As the sound wave 110 travels through the regenerators 126A, 126B, 126C, the temperature gradient amplifies the sound wave 110 (i.e., increases the mechanical power of the sound wave). The amplification is based on an amplification factor, which is a ratio of the increase in heat to the gas by the hot heat exchangers 124A, 124B, 124C to the heat expelled from the thermoacoustic convertor 100 by the cold heat exchangers 122A, 122B, 122C at each thermoacoustic stage 120A, 120B, 120C. In other words, the amplification factor is the slope of the temperature gradient.

In order to optimize the amplification of the sound wave 110, however, the sound wave 110 must have an optimal phasing. The sound wave 100 is comprised of a pressure wave component and a velocity wave component. A phase of the pressure wave component and a phase of the velocity wave component of the initial sound wave are shifted (e.g., 0-90°) with respect to each other. In order to optimize the power output by the thermoacoustic convertor 100, the phase of the pressure wave component and the phase of the velocity wave component must be in sync or match as close as possible as the sound wave travels through each regenerator 126A, 126B, 126C of each thermoacoustic stage 120A, 120B, 120C.

Many factors affect the phase shift of both the pressure and velocity wave. These factors may include the geometry of the thermoacoustic convertor, the diameter of the interconnected tubes, the material of the thermoacoustic convertor, etc. Thus, another function of the cold heat exchangers 122A, 122B, 122C and the hot heat exchangers 124A, 124B, 124C is to adjust the phase shift of both the pressure and velocity waves to align (synchronize) the phasing between the two waves as close as possible before entering the regenerators 126A, 126B, 126C. Consequently, the design of the cold and hot heat exchangers is crucial to the optimized operation of the thermoacoustic convertor.

In the example embodiment disclosed herein, the first regenerator 126A amplifies the sound wave 110 by a ratio of the increase in heat by the second heat exchanger 124A to the expelled heat by the first heat exchanger 122A. Similarly, the second regenerator 126B amplifies the sound wave 110 by a ratio of the increase in heat by the fourth heat exchanger 124B to the expelled heat by the third heat exchanger 122B. Finally, in the example embodiment disclosed herein, the third regenerator 126C amplifies the sound wave 110 by a ratio of the increase in heat by the sixth heat exchanger 124C to the expelled heat by the fifth heat exchanger 122C.

For example, if the increase in heat at the hot heat exchanger is 600 K and the expelled heat at the cold heat exchanger is 200 K, then amplification factor is the ratio of increase in heat to expelled heat, which is 600 K/200 K=3. Thus, the mechanical power of the sound wave 110 is increased by a factor of three. For example, if the mechanical power of the sound wave 110 is 10 kw, as the sound wave 110 travels through the regenerator, the mechanical power of the sound wave 110 leaving the regenerator will be 30 kw. This amplification occurs at every thermoacoustic stage 120A, 120B, 120C in the thermoacoustic convertor 100. As a result, by the time the sound wave 110 loops back to the piston 140, the sound wave 110 has been amplified numerous times based on the amplification factor at each thermoacoustic stage.

This mechanical power is then recouped by the alternator 200 and transformed into usable electrical power (output power). Thus, if the amplification factor at each regenerator 126A, 126B, 126C is 3 and the initial input power is 10 kw, the mechanical power of the sound wave 110 as it loops back to the piston 140 will be approximately 270 kw. In this example, since the input power is 10 kw, the output power removed via the alternator 200 will be approximately 270 kw−10 kw=260 kw.

Figure 3:
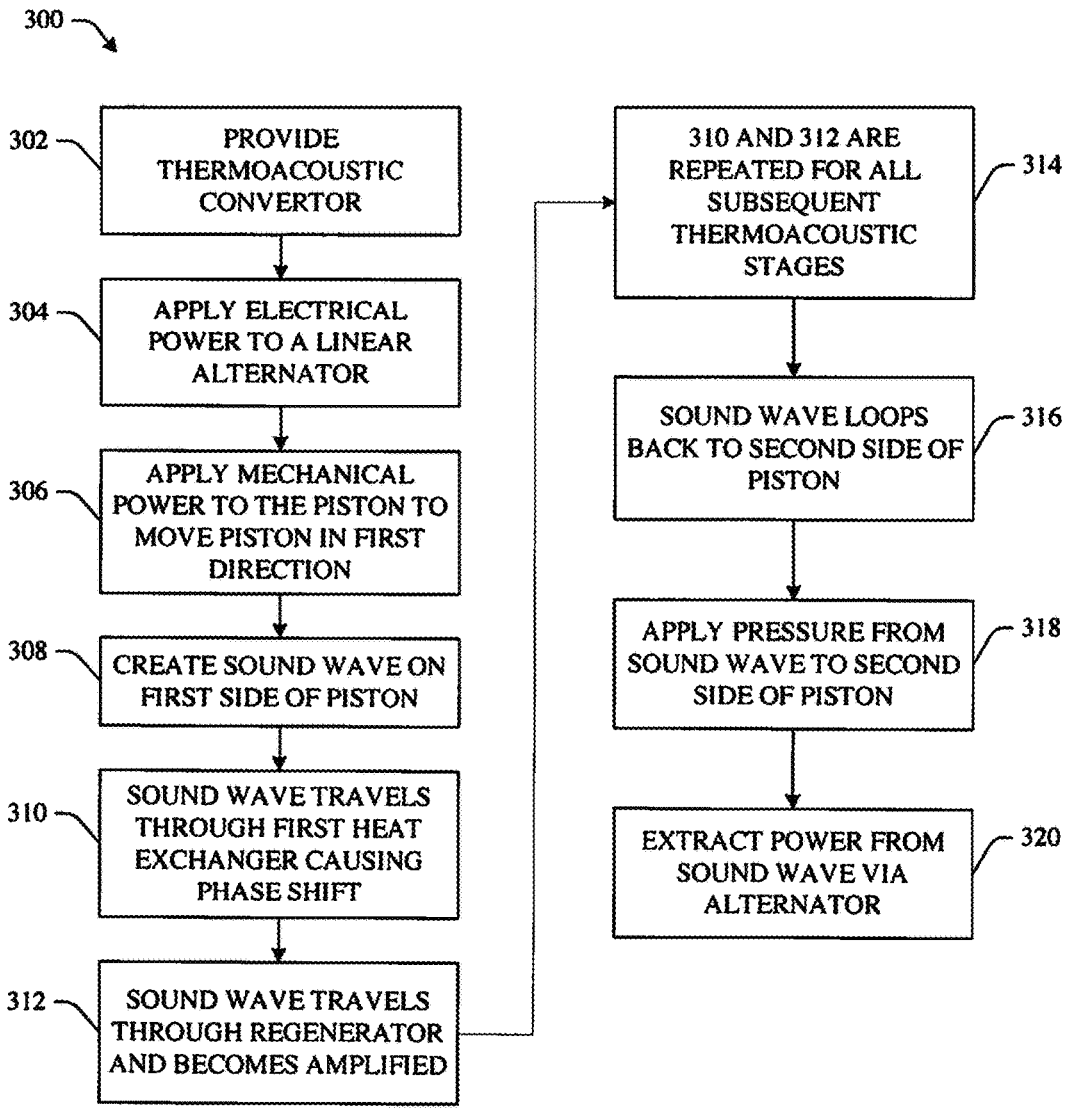
FIG. 3 is a block diagram illustration of the operation of the innovative thermoacoustic convertor in accordance with an aspect of the innovation.

Referring to FIG. 3, operation 300 of the innovative thermoacoustic convertor 100 will now be described. At 302, a thermoacoustic convertor 100 is provided that includes cold heat exchangers, hot heat exchangers, regenerators, and a piston 140. The cold and hot heat exchangers expel heat and increase heat respectively thereby creating a temperature gradient along the regenerators. At 304, an electrical input power is applied to the alternator 200 whereby the electrical power is converted to mechanical power. At 306, the mechanical power is applied to the piston 140 thereby moving the piston 140 in a direction as indicated by the arrow A1. At 308, movement of the piston 140 creates the sound wave 110 on one (first) side 142 of the piston 140 that moves in a direction indicated by the arrow A2. At 310, the sound wave 110 travels through the first heat exchanger 122A which causes the phase of both the pressure wave component and the velocity wave component to shift in order to align the phasing of both waves as described above. At 312, as the sound wave 110 travels through the first regenerator 126A, the temperature gradient amplifies the sound wave 110, as described above. At 314, 310 and 312 are repeated for any subsequent thermoacoustic stages in the thermoacoustic convertor 100. At 316, the sound wave 110 loops back to an opposite (second) side 144 of the piston 140. The sound wave 110 is now amplified and is a high power sound wave 110A, where at 318, some of the power applies a pressure or force to the second side 144 of the piston 140, which facilitates increasing the frequency of the piston 140 and to create a subsequent sound wave on the first side 142 of the piston 140. At 320, the rest of the power is extracted from the moving piston 140 via the linear alternator 200 and is converted to usable electrical energy. The output power of the thermoacoustic convertor 100 is controlled by managing an amplitude of motion of the piston 140.

The use of a high frequency double-acting piston via a thermoacoustic push-pull configuration with a single engine driving both sides of the piston is very unique. Conventional double-acting piston engines require multiple pistons and are often connected and driven by linkages and the piston speed is limited to below 400 Hz. In other configurations multiple engines are used to move the piston.

The innovative thermoacoustic convertor, on the other hand, uses a single engine to push and pull a single piston from both sides. This unique capability enables a high frequency motion while also forming a very compact footprint with a very simple control scheme. Moreover, unlike other thermoacoustic technology that requires electronic feedback, this technology mechanically provides feedback directly through the piston from expansion space to compression space. In addition, multiple thermoacoustic stages can be employed to increase the power density further while still using a single piston regardless of the number of thermoacoustic stages employed.

In other words, using the thermoacoustic stage's reactive forces on the single double-acting piston, eliminating the use of hot moving displacers, and using multiple thermoacoustic stages for acoustic wave phase adjustment, the piston can oscillate at over 400 Hz without using heavy springs. At this high frequency, output current can be minimized and the specific power can be maximized. Moreover, since the thermoacoustic convertor is essentially an empty tube filled with a gas, heat exchangers, regenerators, and a single non-contacting oscillating piston, the thermoacoustic convertor requires no maintenance, is extremely reliable, is low cost, and is light-weight.

An important key to this innovative technology is establishing the proper heat exchanger and regenerator configuration so that the pressure wave component and the velocity wave component phases are matched properly on both sides of the single double-acting piston. The proper phasing achieves two things. First, the engine must amplify an acoustic wave by insuring the pressure and velocity are in phase within the regenerators while simultaneously extracting and inserting power into the engine from both sides of the same piston. Second, the piston dynamics must be matched so that the motion of the piston can be driven by the pressure waves on both sides of the piston coming from the engine. This enables tuning of the engine for maximum reactive power at the piston faces to achieve high frequency motion without requiring heavy springs. Since the engine itself has no hot moving parts it is straight-forward to generate high frequency acoustic waves throughout the tube. Thus, this technology enables a new class of light-weight power systems that are ideal for small aircraft, camping, or micro-cogeneration since it is small, quiet, light-weight, efficient, and essentially maintenance free.

What has been described above includes examples of the innovation. It is, of course, not possible to describe every conceivable composition, article, or methodology for purposes of describing the subject innovation, but one of ordinary skill in the art may recognize that many further combinations and permutations of the innovation are possible. Accordingly, the innovation is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparatus comprising:

an enclosed tubular structure having a continuous closed loop path, wherein the enclosed tubular structure is filled with a gas;

a piston disposed within the enclosed tubular structure;

a transducer operably coupled to the piston configured to move the piston in a first direction along the continuous closed loop path to generate an acoustic wave within the gas on a first side of the piston; and a plurality of thermoacoustic stages disposed in series within the enclosed tubular structure, wherein:

each of the thermoacoustic stages comprises a cold heat exchanger, a hot heat exchanger, and a regenerator, as the acoustic wave travels through each of the thermoacoustic stages, the acoustic wave is first incident on the cold heat exchangers, the cold heat exchangers are configured to align phases of a pressure wave component and a velocity wave component of the acoustic wave prior to the acoustic wave reaching the regenerators, and the acoustic wave is amplified in each of the thermoacoustic stages such that an amplified acoustic wave is incident on a second side of the piston to generate an additional acoustic wave.

2. The apparatus of claim 1, wherein the enclosed tubular structure comprises a plurality of segments interconnected via a plurality of junctions, wherein the piston is disposed within a first segment of the plurality of segments and each additional segment of the plurality of segments includes at least one thermoacoustic stage.

3. The apparatus of claim 2, wherein one of the additional segments includes more than one thermoacoustic stage.

4. The apparatus of claim 2, wherein the plurality of segments comprises three segments forming a triangular structure.

5. The apparatus of claim 1, wherein the transducer is configured to capture a portion of mechanical energy of the amplified acoustic wave and convert the mechanical energy to electrical energy.

6. The apparatus of claim 5, wherein the transducer is a linear alternator.

7. The apparatus of claim 1, wherein the piston is configured to oscillate at over 400 Hz.

8. The apparatus of claim 1, wherein the gas is helium.

9. The apparatus of claim 1, wherein the enclosed tubular structure is constructed from one of steel and copper.

10. The apparatus of claim 1, wherein there are no acoustic signal generators disposed between any of the thermoacoustic stages other than the piston.

11. A method comprising:

providing a structure enclosing a continuous flow path, wherein a piston and a plurality of thermoacoustic stages are disposed in series within the structure, wherein each of the thermoacoustic stages comprises a cold heat exchanger, a hot heat exchanger, and a regenerator;

supplying power to the piston to cause the piston to move along the continuous flow path in a first direction to generate an acoustic wave on a first side of the piston;

as the acoustic wave travels along the continuous flow path, aligning phases of pressure and velocity components of the acoustic wave within each of the cold heat exchangers such that the phases are aligned prior to reaching each of the regenerators to amplify the acoustic wave at each of the thermoacoustic stages and generate an amplified acoustic wave; and generating an additional acoustic wave as the amplified acoustic wave is incident on a second side of the piston.

12. The method of claim 11, further comprising converting, via a transducer operably coupled to the piston, a portion of mechanical energy of the amplified acoustic wave to electrical energy.

13. The method of claim 12, wherein the transducer is a linear alternator.

14. The method of claim 13, wherein the supplying of the power to the piston is performed via the linear alternator.

15. The method of claim 11, wherein the structure contains a gas that is one of helium and hydrogen.

16. The method of claim 15, wherein the structure comprises a plurality of tubular segments interconnected via a plurality of junctions, wherein the piston is disposed within a first tubular segment of the plurality of tubular segments and each additional tubular segment of the plurality of tubular segments includes at least one thermoacoustic stage.

17. The method of claim 16, wherein one of the additional segments includes more than one thermoacoustic stage.

18. The method of claim 16, wherein the plurality of tubular segments comprises three tubular segments forming a triangular structure.

19. The method of claim 11, wherein there are no acoustic signal generators disposed between any of the thermoacoustic stages other than the piston.

* * * * *